US009728846B2

(12) United States Patent
Emerick et al.

(10) Patent No.: US 9,728,846 B2
(45) Date of Patent: Aug. 8, 2017

(54) LOW PASSIVE INTERMODULATION ANTENNA APPARATUS AND METHODS OF USE

(71) Applicant: Pulse Electronics, Inc.

(72) Inventors: Curtis Emerick, San Diego, CA (US); Le Pham, San Diego, CA (US)

(73) Assignee: PULSE ELECTRONICS, INC., San Diego, CA (US)

( * ) Notice: Subject to any disclaimer, the term of this patent is extended or adjusted under 35 U.S.C. 154(b) by 88 days.

(21) Appl. No.: 14/452,253

(22) Filed: Aug. 5, 2014

(65) Prior Publication Data

US 2015/0042536 A1 Feb. 12, 2015

Related U.S. Application Data

(60) Provisional application No. 61/864,432, filed on Aug. 9, 2013.

(51) Int. Cl.

| | |
|---|---|
| ***H01Q 1/48*** | (2006.01) |
| ***H01Q 1/36*** | (2006.01) |
| ***H01Q 1/42*** | (2006.01) |
| ***H01Q 9/40*** | (2006.01) |

(52) U.S. Cl.

CPC ..... *H01Q 1/36* (2013.01); *H01Q 1/42* (2013.01); *H01Q 1/48* (2013.01); *H01Q 9/40* (2013.01)

(58) Field of Classification Search

CPC ..... H01Q 9/40; H01Q 9/38; H01Q 1/42
USPC ..... 343/848
See application file for complete search history.

(56) References Cited

U.S. PATENT DOCUMENTS

| | | | | |
|---|---|---|---|---|
| 5,864,318 A * | 1/1999 | Cosenza et al. | ..... | H01Q 1/32 343/700 MS |
| 2010/0103070 A1* | 4/2010 | Coupez | ..... | H01Q 9/40 343/848 |

* cited by examiner

*Primary Examiner* — Graham Smith
(74) *Attorney, Agent, or Firm* — Gazdzinski & Associates, PC

(57) ABSTRACT

Low passive intermodulation (PIM) antenna assemblies and methods for utilizing the same. In one embodiment, the low PIM antenna assembly includes an ultra-wide band quarter wave monopole over ground plane antenna apparatus that operates within a band from 698-5900 MHz. The radiating element is comprised of three (3) features that are separated from one another by one hundred twenty (120°) thus producing a triangular shaped pattern. Such a configuration reduces the nulls by about twenty percent (20%) as compared with similar antenna implementations having flat radiating elements. Moreover, in order to reduce the diameter of the ground plane while simultaneously increasing the electrical length of the ground plane, forming of the ground plane is required. Methods of using the aforementioned low PIM antenna assembly are also disclosed.

20 Claims, 10 Drawing Sheets

LOW PASSIVE INTERMODULATION ANTENNA APPARATUS AND METHODS OF USE

PRIORITY

This application claims the benefit of priority to co-owned U.S. Provisional Patent Application Ser. No. 61/864,432 of the same title filed Aug. 9, 2013, the contents of which are incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present disclosure relates generally to antenna solutions, and more particularly in one exemplary aspect to antenna solutions that have a desired peak passive intermodulation ("PIM") performance; e.g., in one embodiment lower than −155 dBc.

DESCRIPTION OF RELATED TECHNOLOGY

Antennas in wireless communication networks are critical devices for both transmitting and receiving signals with and without amplification. With the evolution of network communication technology migrating from less to more capable technology; e.g., third generation systems ("3G") to fourth generation systems ("4G") with higher power, the need for antennas which can clearly receive fundamental frequencies or signals with minimal distortion are becoming more critical. The distortion experienced during signal reception is due in large part to the by-products of the mixture of these fundamental signals. Passive intermodulation, or PIM, is the undesired by-products of these mixed signals, which can severely interfere and inhibit the efficiency of a network system's capability in receiving the desired signals. With higher carrier power levels experienced in today's modern wireless communication networks, low PIM antennas with a peak PIM performance (for instance, lower than about −153 decibels relative to the carrier ("dBc") for cellular network applications are desired (such as 3G (e.g., 3GPP, 3GPP2, and UMTS), HSDPA/HSUPA, TDMA, CDMA (e.g., IS-95A, WCDMA, etc.), GSM, WiMAX (802.16), Long Term Evolution (LTE) and LTE-Advanced (LTE-A), etc.). In addition, over time, the PIM value may drop due to nonlinearity, dissimilar materials, thermal expansion and/or contraction, and galvanic corrosion.

Accordingly, there is a need for apparatus, systems and methods that eliminate nonlinearity, such as via the reduction of dissimilar materials in antenna embodiments.

SUMMARY

The aforementioned needs are satisfied herein by providing improved antenna apparatus, and methods for manufacturing and using the same.

In a first aspect, a low passive intermodulation (PIM) antenna apparatus is disclosed. In one embodiment, the low PIM antenna apparatus includes a radiating element comprised of a plurality of protruding portions. In one variant, each of the protruding portions are separated from one another by an equal amount. The low PIM antenna apparatus of this variant further includes a formed ground plane comprising an electrical path length and a diameter, the electrical path length being greater than the diameter and a connector that is coupled to the formed ground plane and the radiating element.

In a second aspect, a ground plane apparatus for use with an antenna apparatus such as, for example, a low PIM antenna apparatus is disclosed.

In a third aspect, a radiating element for use with an antenna apparatus such as, for example, a low PIM antenna apparatus is disclosed.

In a fourth aspect, methods of manufacturing the aforementioned low PIM antenna apparatus are disclosed. In one embodiment, and in order to obtain a reliable low PIM performance in long term use, the antenna is designed and manufactured by using laser welds as much as possible instead of the use of traditional soldering methods. These laser welded joints are used so as to avoid the use of dissimilar materials within RF paths or possible cold solder joints, which are known to cause PIM. In another embodiment, all custom flanged connectors or adapters are laser welded to the ground plane. Furthermore, screws and dissimilar metallic components within the RF path are avoided as they are nonlinear junctions which could affect low PIM performance in a long term use.

In a fifth aspect, methods of manufacturing the aforementioned ground plane apparatus are disclosed.

In a sixth aspect, methods of manufacturing the aforementioned radiating element are disclosed.

In a seventh aspect, methods of using the aforementioned antenna apparatus are disclosed.

Various objects, features, aspects and advantages of the inventive subject matter will become more apparent from the following detailed description of preferred embodiments, along with the accompanying drawings.

BRIEF DESCRIPTION OF THE DRAWINGS

The features, objectives, and advantages of the disclosure will become more apparent from the detailed description set forth below when taken in conjunction with the drawings, wherein.

DETAILED DESCRIPTION

Figure 1:
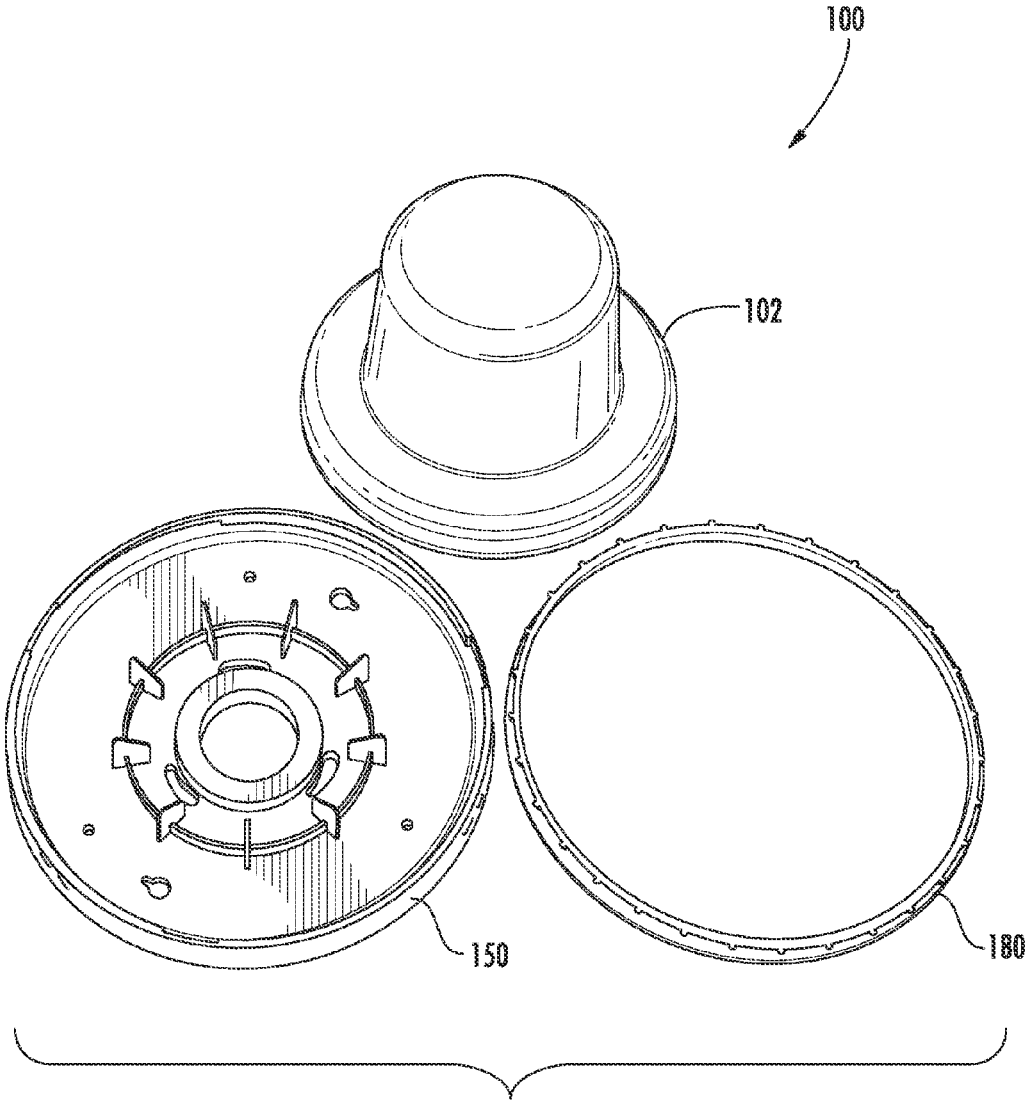
FIG. 1 is a perspective view of various components of one embodiment of the low PIM antenna apparatus in accordance with the principles of the present disclosure.

Reference is now made to the drawings wherein like numerals refer to like parts throughout.

As used herein, the terms "antenna", and "antenna assembly" refer without limitation to any system that incorporates a single element, multiple elements, or one or more arrays of elements that receive/transmit and/or propagate one or more frequency bands of electromagnetic radiation. The radiation may be of numerous types, e.g., microwave, millimeter wave, radio frequency, digital modulated, analog, analog/digital encoded, digitally encoded millimeter wave energy, or the like. The energy may be transmitted from location to another location, using, or more repeater links, and one or more locations may be mobile, stationary, or fixed to a location on earth such as a base station.

As used herein, the terms "board" and "substrate" refer generally and without limitation to any substantially planar or curved surface or component upon which other components can be disposed. For example, a substrate may comprise a single or multi-layered printed circuit board (e.g., FR4), a semi-conductive die or wafer, or even a surface of a housing or other device component, and may be substantially rigid or alternatively at least somewhat flexible.

As used herein, the terms "portable device", "mobile device", "client device", and "computing device", include, but are not limited to, personal computers (PCs) and mini-computers, whether desktop, laptop, or otherwise, set-top boxes, personal digital assistants (PDAs), handheld computers, personal communicators, tablet/phablet computers, portable navigation aids, J2ME equipped devices, cellular telephones, smartphones, tablet computers, personal integrated communication or entertainment devices, portable navigation devices, or literally any other device capable of processing data.

Furthermore, as used herein, the terms "radiator," "radiating plane," and "radiating element" refer without limitation to an element that can function as part of a system that receives and/or transmits radio-frequency electromagnetic radiation; e.g., an antenna. Hence, an exemplary radiator may receive electromagnetic radiation, transmit electromagnetic radiation, or both.

The terms "feed", and "RF feed" refer without limitation to any energy conductor and coupling element(s) that can transfer energy, transform impedance, enhance performance characteristics, and conform impedance properties between an incoming/outgoing RF energy signals to that of one or more connective elements, such as for example a radiator.

As used herein, the terms "top", "bottom", "side", "up", "down", "left", "right", and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB).

As used herein, the term "wireless" means any wireless signal, data, communication, or other interface including without limitation Wi-Fi, Bluetooth, 3G (e.g., 3GPP, 3GPP2, and UMTS), HSDPA/HSUPA, TDMA, CDMA (e.g., IS-95A, WCDMA, etc.), FHSS, DSSS, GSM, PAN/802.15, WiMAX (802.16), 802.20, narrowband/FDMA, OFDM, PCS/DCS, Long Term Evolution (LTE) or LTE-Advanced (LTE-A), analog cellular, Zigbee, Near field communication (NFC)/RFID, CDPD, satellite systems such as GPS and GLONASS, and millimeter wave or microwave systems.

Overview

The present disclosure provides, inter alia, improved low PIM antenna components, assemblies, and methods for manufacturing and utilizing the same.

More specifically, embodiments of the present disclosure include an ultra-wide band quarter-wave monopole over ground plane antenna apparatus that operates within a desired wide frequency band (e.g., from 698-5900 MHz in one exemplary implementation). The radiating structure comprises a monopole antenna comprised of three (3) features that are separated from one another by one hundred twenty (120°), thus producing a triangular shaped pattern when viewed from above. Such a configuration is advantageous as it reduces the nulls by about twenty percent (20%) as compared with similar antenna implementations having a single flat radiating element.

In addition, adding the third leg to shunt feed to ground allows for tuning the low NM antenna apparatus to obtain the desired RF frequency bandwidth.

Moreover, in order to reduce the diameter of the ground plane while simultaneously increasing the electrical length of the ground plane, forming of the ground plane (see e.g., FIGS. 3A-3F) is required. In one exemplary embodiment, forming the ground plane adds approximately 25 mm in electrical length, thus reducing the diameter of the ground plane from one hundred and twenty one (121) mm to ninety-six (96) mm in the exemplary embodiment. The front to back ratios of exemplary embodiments of the low PIM antenna apparatus are also improved, thereby improving the PIM level by approximately −5 dBc.

In one exemplary implementation, the use of screws, rivets and gaps from around, for example, the connector flange is reduced or even eliminated. In addition, all electrical components utilized within such a desired antenna apparatus (i.e., radiating element, ground plane, and connector) are made from the same nonferrous material. Such a solution advantageously reduces the overall cost and improves the reliability of the underlying antenna by, inter alia, utilizing state of the art technologies such as e.g., laser welding.

Methods of manufacturing and using the aforementioned low PIM antenna assembly are also disclosed.

Exemplary Embodiments

Detailed descriptions of the various embodiments and variants of the apparatus and methods of the present disclosure are now provided. While primarily discussed in the context of low passive intermodulation ("PIM") antennas for distributed antenna systems ("DAS"), the various apparatus and methodologies discussed herein are not so limited. In fact, many of the apparatus and methodologies described herein are useful in the manufacture of any number of antenna apparatus that can benefit from the radiating element and ground plane geometries and methods described herein, which may also be useful in different applications, and/or provide different signal conditioning functions.

Low Passive Intermodulation (PIM) Antenna Apparatus—

Some exemplary embodiments of the present disclosure relate to low cost, low PIM antennas for distributed antenna systems ("DAS") with broadband frequencies in the range of 698-2700 MHz. Antenna embodiments of the present disclosure include a plastic radome, a conductive (e.g. metal) radiating element, a conductive (e.g. metal) ground plane, and a feeding network, the latter which may comprise, for example, a single custom direct mount connector, an N type or 7-16DIN type connector, or a custom cable pigtail with custom connectors and adapters. Exemplary embodiments of the present disclosure also include a novel mounting base which can be utilized in conjunction with various feeding network interfaces. The radiating element and the ground plane are, in one implementation, specifically made to meet desired voltage standing wave ratios ("VWSR") with form factors and assembly techniques which help to achieve the desired PIM level for use in e.g., modern wireless communication networks.

Embodiments of the present disclosure also include a mounting base that is designed so that when mounted against, for example, an office ceiling tile or any hard installation surface, it can house all three (3) antennas of three (3) connector configurations. For example, a mounting base is disclosed that can be used in conjunction with N pigtail, N direct mount and 7-16 DIN direct mount in a way that results in fast installation and fast removal. The mounting base is utilized with the antenna with N or 7-16 DIN direct mount connector for installation, and is optional for the antenna with N pigtail connector. The mounting base also has features to allow the antennas to be exchangeable with other brand mounting bases.

Referring now to FIG. 1, a first embodiment of a low PIM antenna apparatus 100 for use in a DAS is shown and described in detail. Specifically, FIG. 1 illustrates the main components of the low PIM antenna apparatus including a radome 102 that is configured to house the radiating element (110, FIG. 1A); a mounting base 150; and a cover ring which holds the antenna apparatus against the mounting base.

Figure 1A:
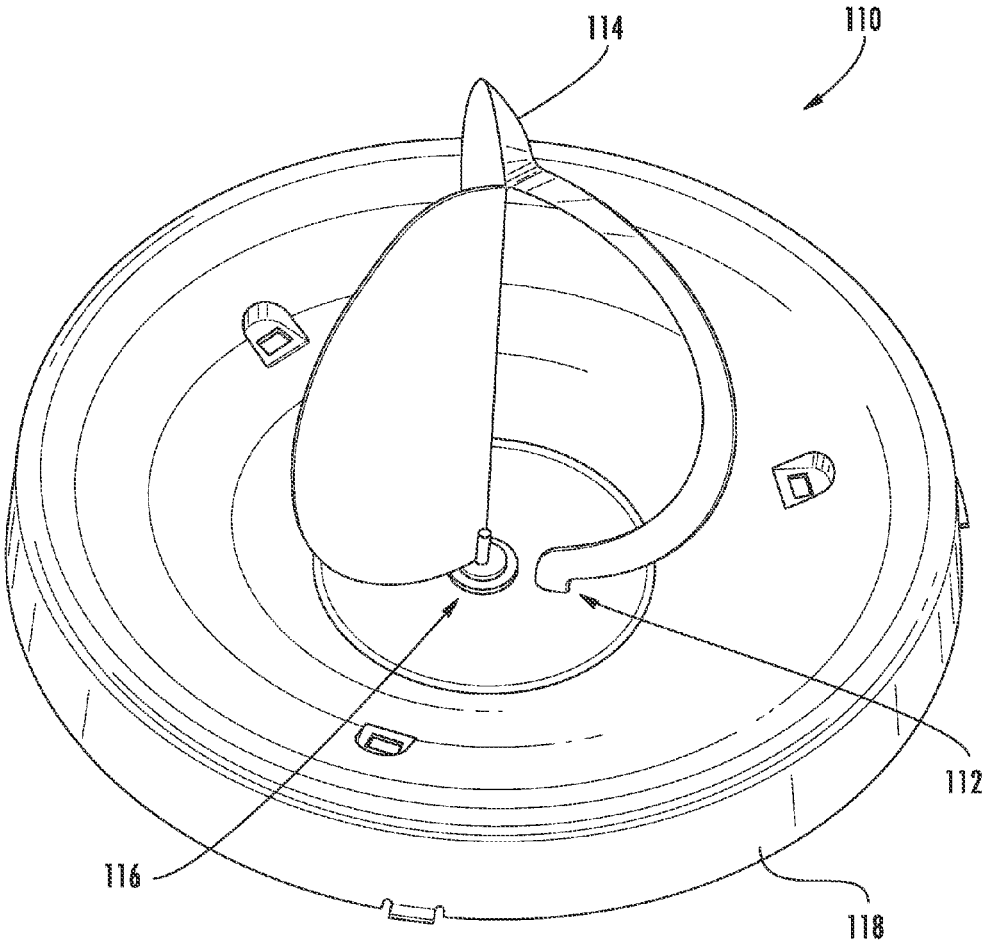
FIG. 1A is a perspective view of one embodiment the radiating element of the low PIM antenna apparatus in accordance with the principles of the present disclosure.

Referring now to FIG. 1A, the radiating element 110 of the low PIM antenna apparatus of FIG. 1 shows the radiating element 114 soldered to a custom N direct mount connector 116. In one exemplary embodiment, the radiating element is made from a non-ferromagnetic metal and plated with a white bronze or tin plated brass in order to reduce costs. In the illustrated embodiment, the radiating element is laser welded to the ground plane 118 at its tuning leg 112 on both sides of the ground plane. The ground plane 118 is formed in a complex form, such as those forms illustrated with respect to FIGS. 3A-3F, in order to achieve a desired PIM and to reduce the overall size (i.e., diameter) of the low PIM antenna apparatus 100. In an exemplary embodiment, the ground plane is made from a non-ferromagnetic metal (such as tin plated brass or white bronze plated brass). While the use of a non-ferromagnetic metal is exemplary, it envisioned that the ground plane could comprise non-ferromagnetic plating, either in whole, or locally for soldering at the connector pin and the tuning leg area. The ground plane could, in alternative embodiments, be protected elsewhere from e.g., corrosion by alternative surface treatments such as chemical conversion, plating, etc. so long as these treatments do not contain any ferromagnetic metal elements.

Figure 1B:
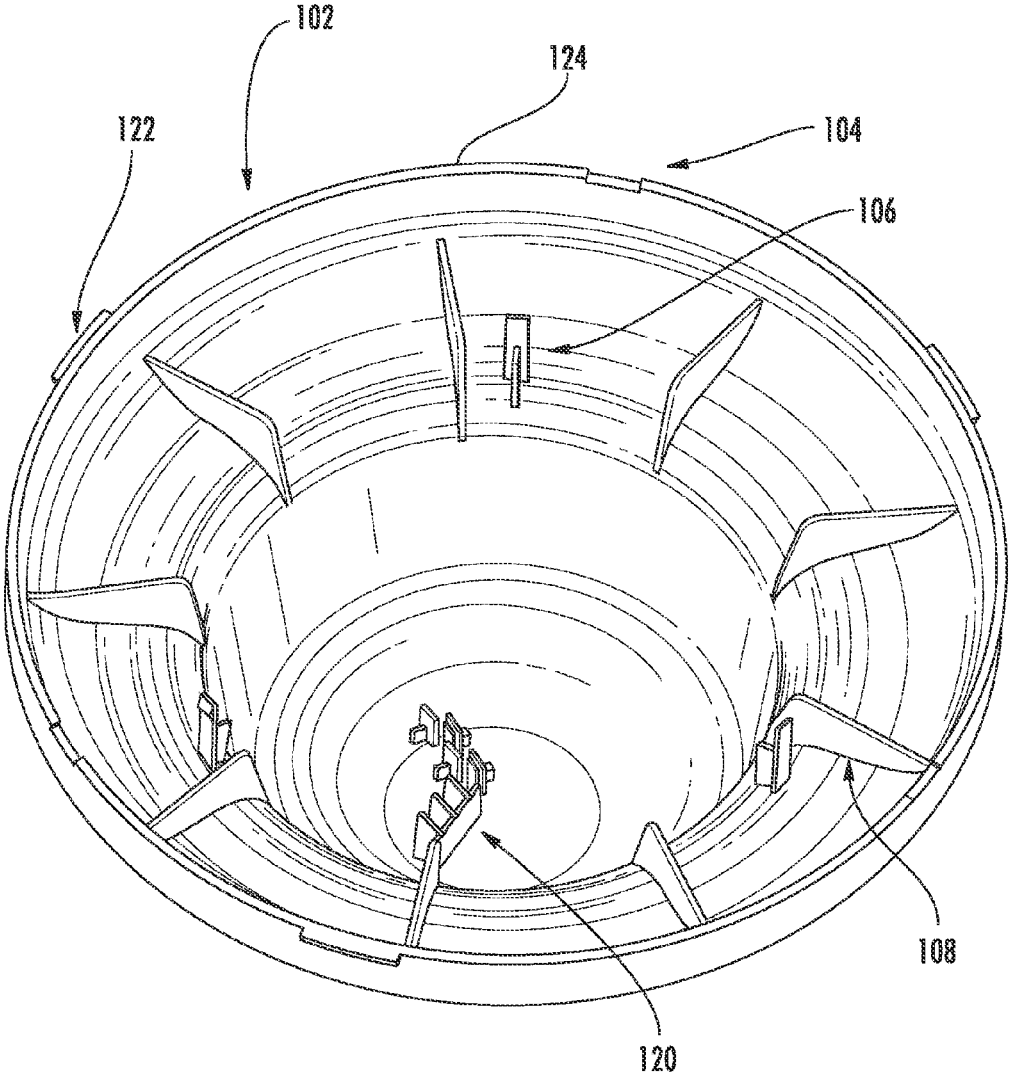
FIG. 1B is a perspective view of the underside of the radome cover utilized in conjunction with the exemplary low PIM antenna apparatus of FIG. 1.

Referring now to FIG. 1B, an exemplary radome 102 for use with the low PIM antenna apparatus of FIG. 1 is shown and described in detail. Specifically, the radome illustrated has three (3) outer tabs 122 that are located on the outer rim 124 that are configured to engage the grooves of the mounting base shown in FIG. 1C. These three (3) outer tabs are inserted into the respective grooves of the mounting base and are twisted until the radome locks into position with the mounting base. The radome also includes locating and restraining ribs 120 that are configured to support the radiating element. The radome further includes supporting ribs 108 that support the ground plane of the low PIM antenna apparatus of FIG. 1. Three (3) snaps 106 are also included that are configured to hold the ground plane of the low PIM antenna apparatus to the radome via cut features located on the ground plane. While a specific configuration is shown, these snaps can be of different shapes and can be located at different positions within the radome. Alternatively, these snaps can also be located on the inner wall of the radome, and/or mechanisms or techniques other than snaps can be used. Recess areas 104 on the radome rim 124 are configured so as to become anti-rotation features for the ground plane in the low PIM antenna apparatus when installed onto the radome.

Figure 1C:
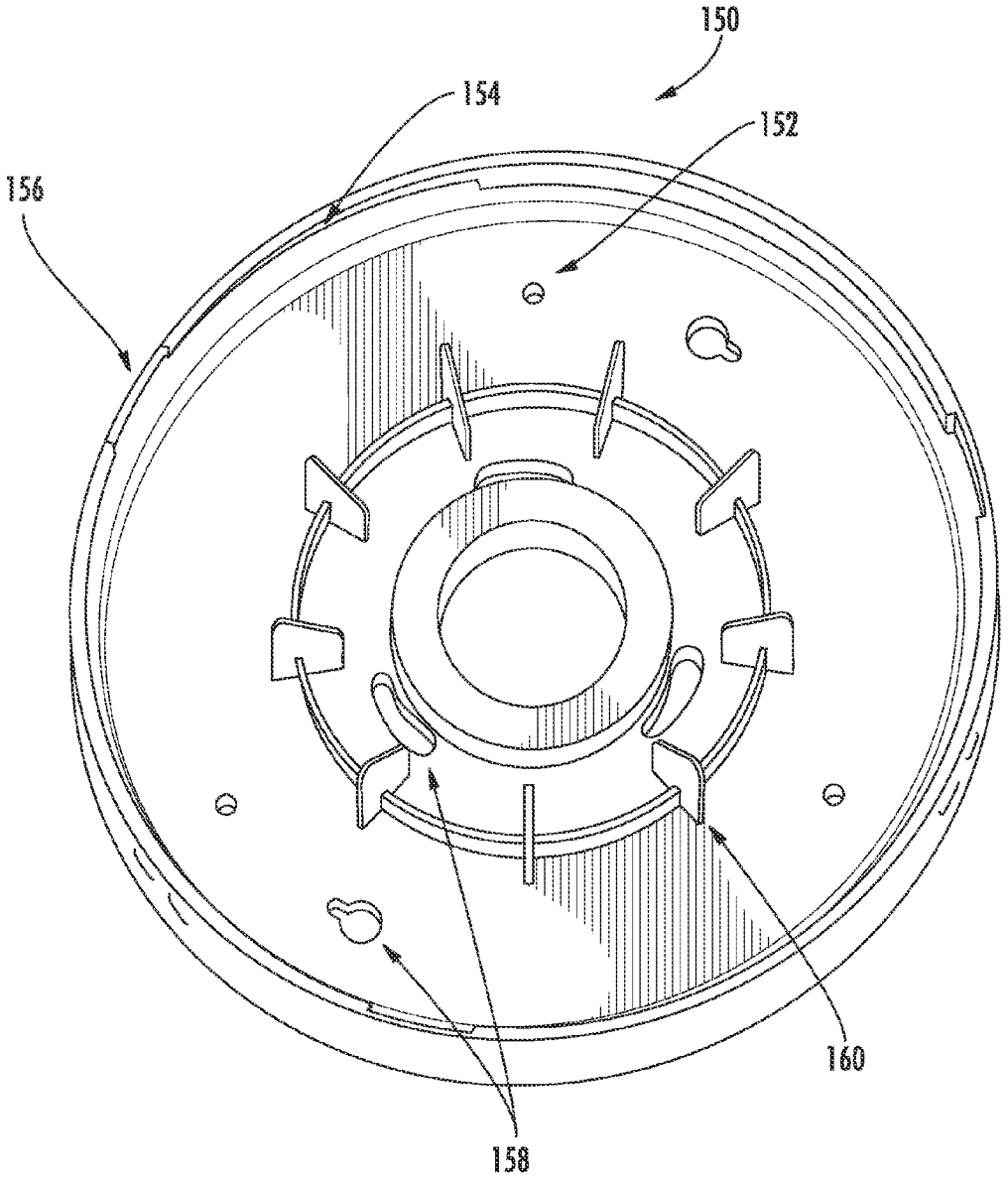
FIG. 1C is a perspective view of the mounting base of the exemplary low PIM antenna apparatus of FIG. 1.
Figure 1D:
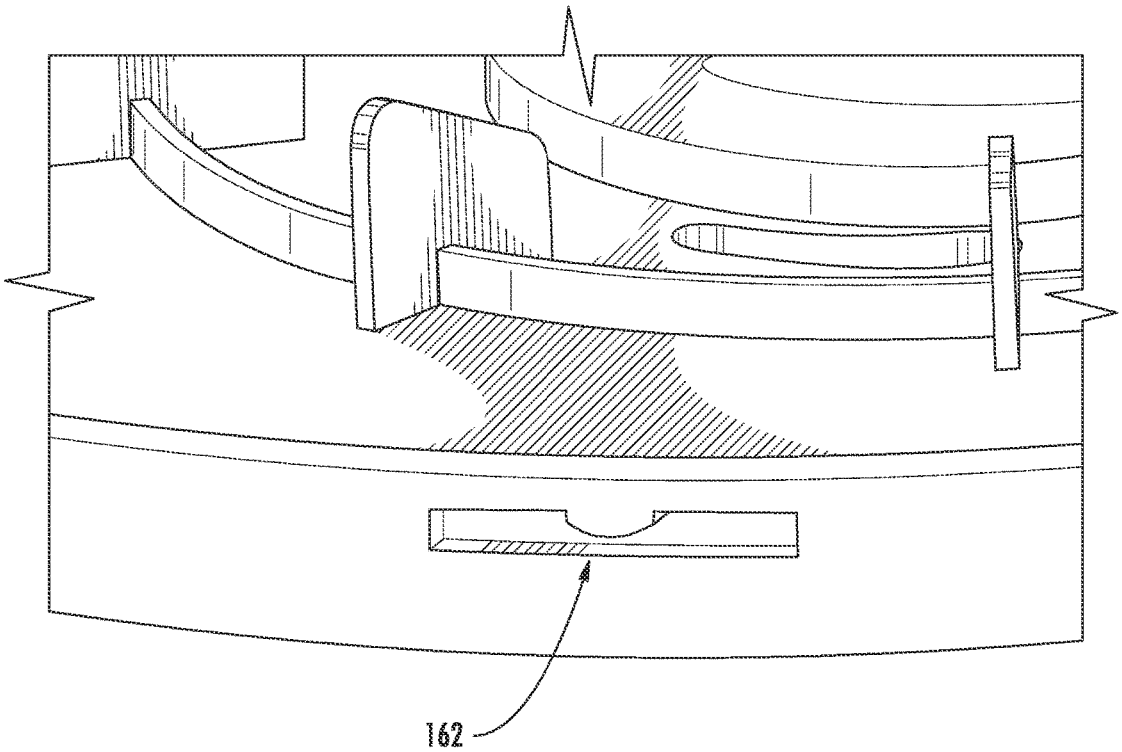
FIG. 1D is a perspective view of the snap features of the exemplary mounting base illustrated in FIG. 1C.

Referring now to FIG. 1C, an exemplary embodiment of the mounting base 150 for use with the exemplary low PIM antenna apparatus described in FIG. 1 is shown and described in detail. The mounting base is, in an exemplary embodiment, manufactured from a polymer material and molded such that it includes a flange channel 154. A number of screw holes 152 are included in the plastic mounting base and are configured to mount the mounting base to a ceiling tile or any other suitable installation surface. A series of ribs 160 are also included on the plastic mounting base, and are configured to offer structural support for the inserted ground plane. In addition to the screw holes 152 illustrated, several slots 158 are also optionally included in the illustrated embodiment as exchangeable mounting features with other well-known brand antenna mounting devices. The flange channel 154 is configured to receive tabs located on the radome such that these tabs from the radome can be inserted into the flange channel located on the mounting base flange 156. These tabs (122, FIG. 1B) located on the radome can thus be inserted into the flange channel and subsequently twisted in order to lock these embedded snaps 162 as shown in FIG. 1D.

Figure 2A:
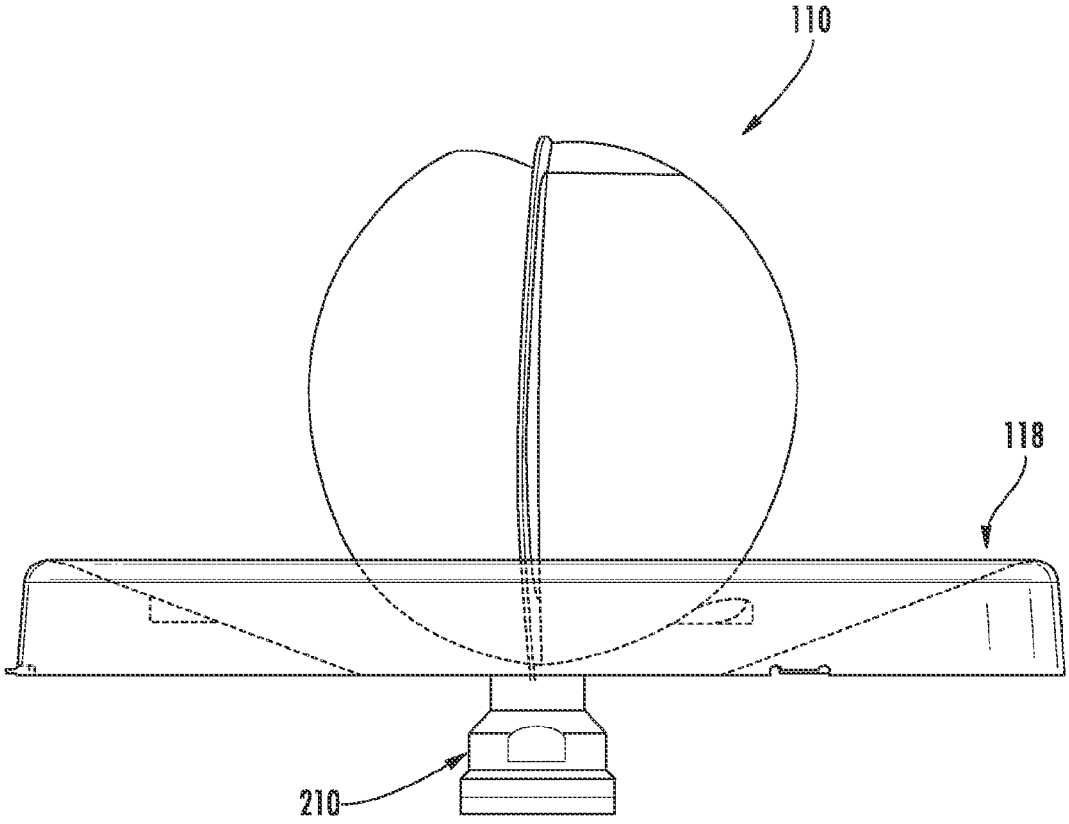
FIG. 2A is a front plan view of the exemplary low PIM antenna apparatus of FIG. 1 with one embodiment of a 7-16 DIN direct mount connector, in accordance with the principles of the present disclosure.
Figure 2B:
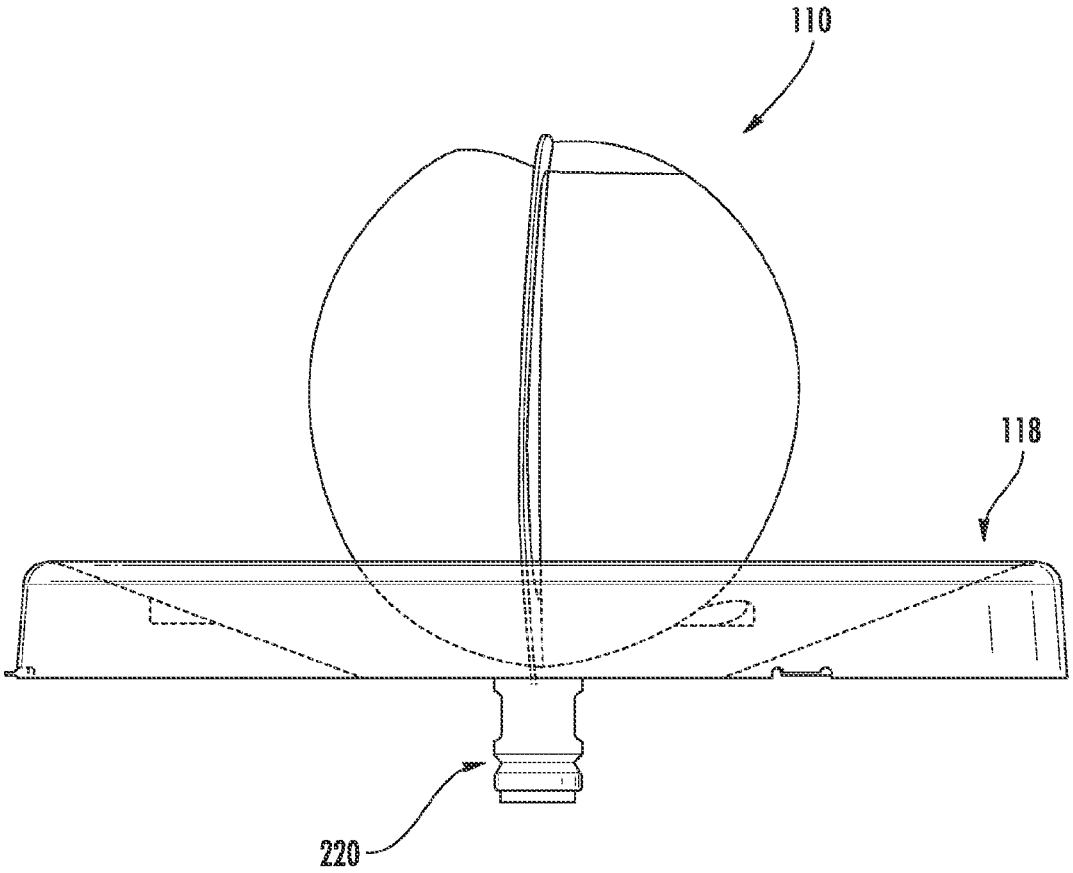
FIG. 2B is a front plan view of the exemplary low PIM antenna apparatus of FIG. 1, with one embodiment of an N direct mount connector, in accordance with the principles of the present disclosure.

FIGS. 2A and 2B illustrate a side view of the low PIM antenna apparatus illustrated in FIG. 1, with a custom 7-16 DIN direct mount (210, FIG. 2A) and custom N direct mount connector (220, FIG. 2B), respectively. The connectors illustrated in FIGS. 2A and 2B are, in an exemplary embodiment, laser welded to the ground plane 118 on both sides thereof in order to sustain the high mating assembly torque and to avoid any possible non-linearity of connection which could cause undesirable PIM.

Figure 2C:
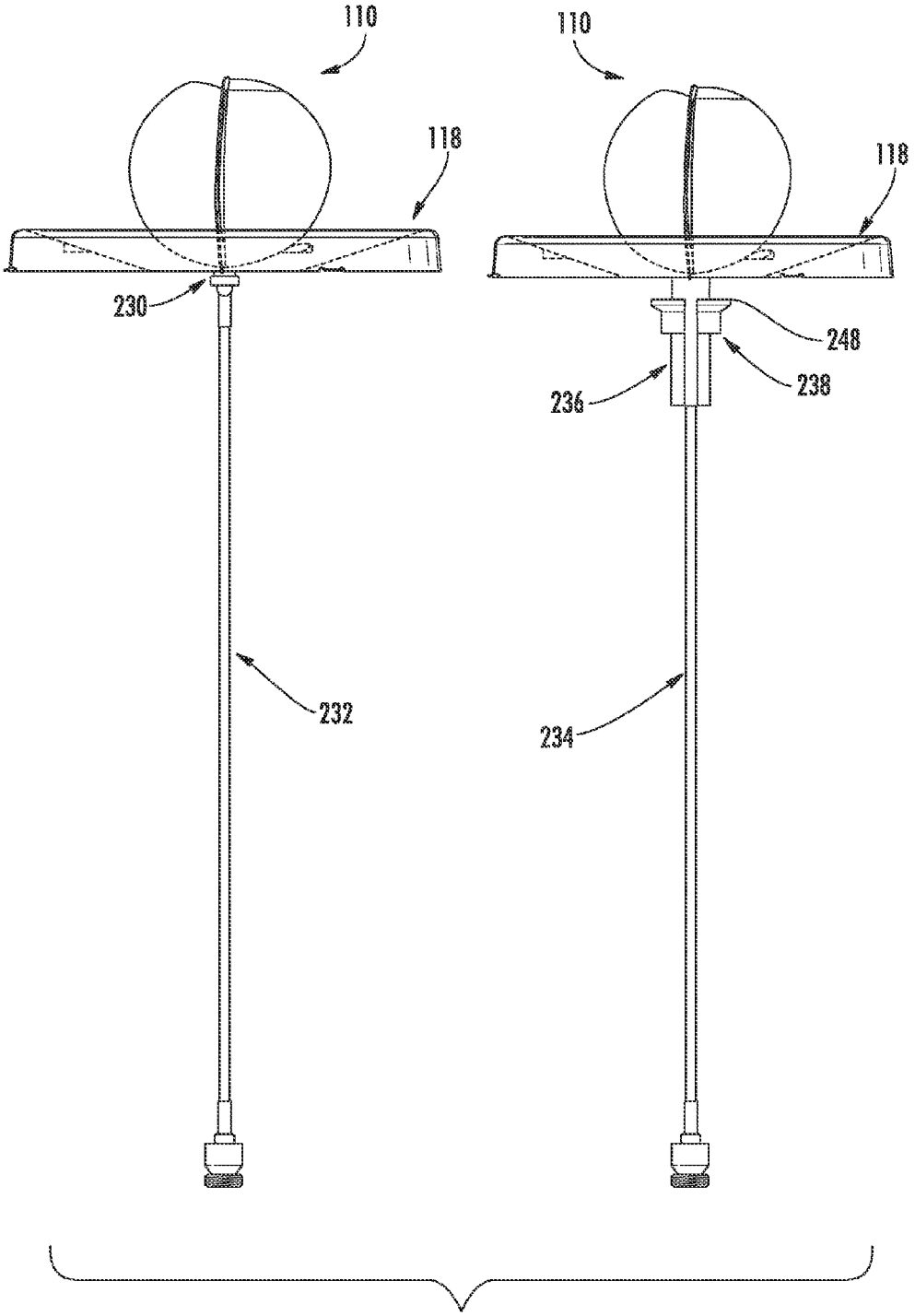
FIG. 2C is a front plan view of the exemplary low PIM antenna apparatus of FIG. 1, with one embodiment of a cable pigtail connector, in accordance with the principles of the present disclosure.

FIG. 2C illustrates an alternative configuration of the radiating element 110 showing the cable pigtail 232 with an adapter 230 that is welded to the ground plane 118 at one end. The adapter has threads that are assembled to a threaded plastic stem 236 such that this illustrated antenna configuration can be mounted directly to an office ceiling tile via a through hole. The adapter mount also includes a custom plastic nut 238 and washer 248. While a separate plastic nut and washer is illustrated, it is appreciated that the nut could instead be of a larger size with a molded flange incorporated thereon which would function as a washer. Such an embodiment presents opportunities for cost reduction.

The other end of the illustrated cable pigtail includes a standard connector of, for example, an N or 7-16 DIN type that is soldered to a semi-flexible cable 234. The semi-flexible cable incorporates enough flexibility so as to ease assembly. The length of the semi-flexible cable could be of any desired length so long as the gain loss is acceptable.

Figure 2D:
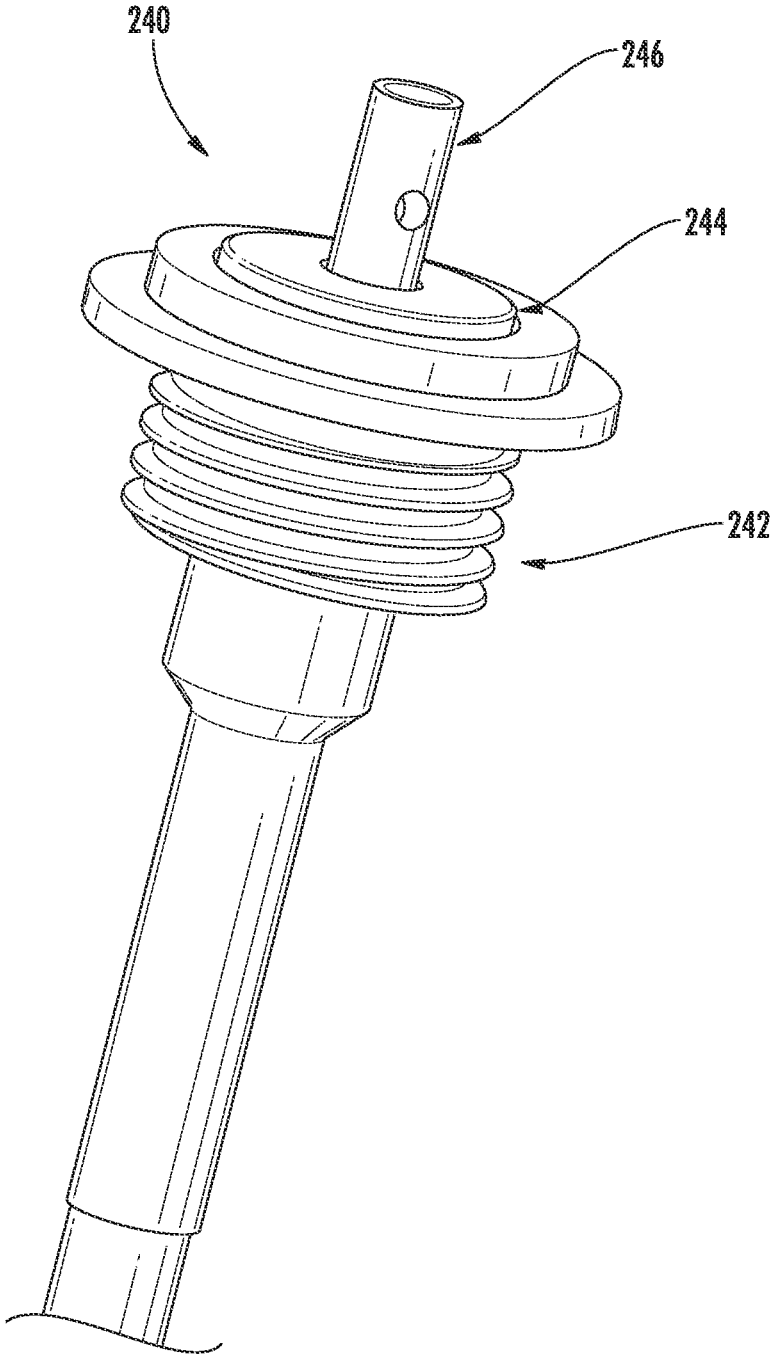
FIG. 2D is a perspective view of one embodiment of a custom adapter for use with the exemplary low PIM antenna apparatus of FIG. 1.

Referring now to FIG. 2D, yet another alternative embodiment is shown that utilizes a custom adapter with a metal body 242, a Teflon® insert 244 and a conductor pin 246. The conductor of the semi-flexible cable is subsequently soldered to the adapter conductor pin, while the braided portion of the semi-flexible cable is soldered to the adapter body. While discussion of a semi-flexible cable is exemplary, it is appreciated that a semi-rigid cable of the same size could readily be substituted if desired although there will be lesser flexibility in the assembly. In addition to those specific embodiments discussed above, the connector and/or the adapter could also have a flange (not shown) that is soldered and/or laser welded to the ground plane.

Referring now to FIGS. 3A-3F, embodiments illustrating various cross-sectional views of exemplary ground plane 118 embodiments suitable for use with the exemplary low PIM antenna apparatus described in FIG. 1 is shown and described in detail. In order to obtain a small size for the antenna apparatus (which is often preferred by network carriers) as well as a good low PIM performance, the form and shape of the ground plane is critical. The ground plane, formed and shaped as a single continuous piece, extends its electric length comparable to a much larger, flat ground plane, thus effectively increasing the overall antenna size which is an attribute that is desirable for the low PIM performance. The ground plane is in an exemplary implementation made from a non-ferromagnetic material (such as white bronze plated brass or tin plated brass) for reduced cost, corrosion prevention and to lower PIM causes.

Figure 3A:
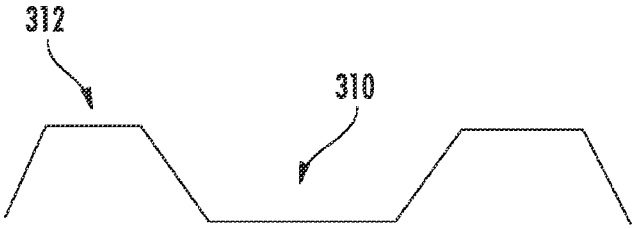
FIGS. 3A-3F are front cross-sectional views of various embodiments of a ground plane for use with the low PIM antenna apparatus of FIG. 1.
Figure 3B:
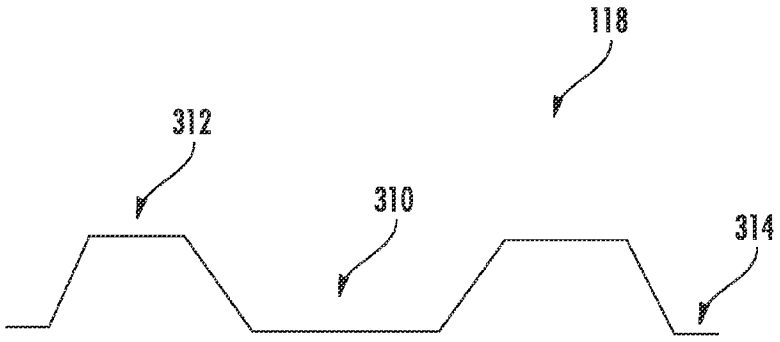
Figure 3C:
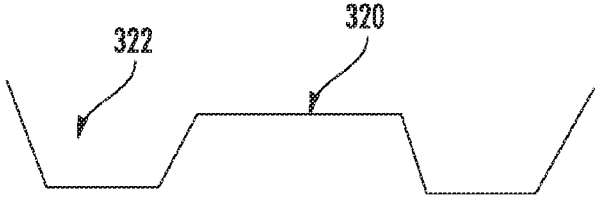
Figure 3D:
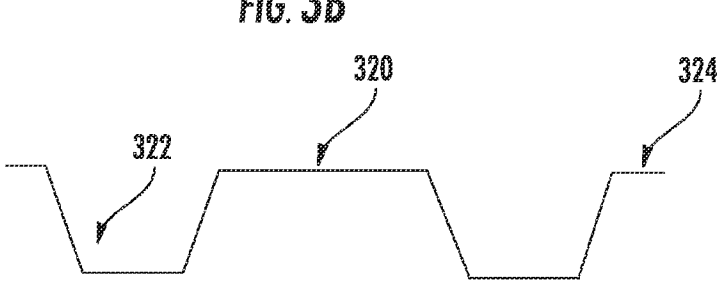
Figure 3E:
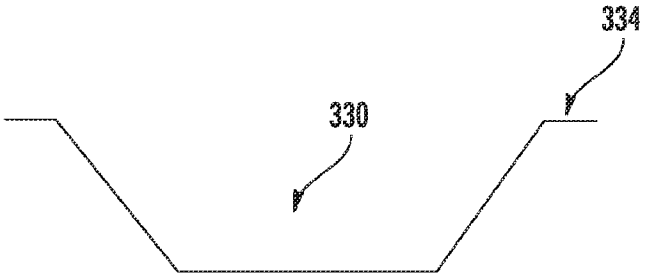
Figure 3F:
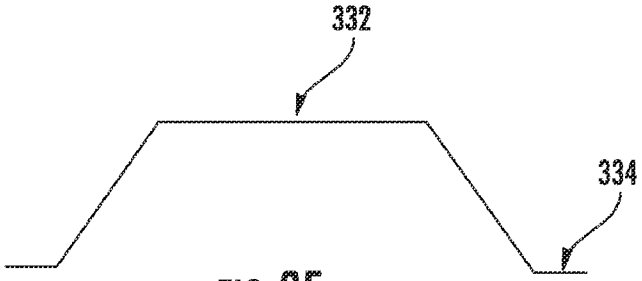

FIGS. 3A-3B illustrate similar ground plane structures with elevated outer portions 312 and a depressed inner portion 310. Furthermore, the embodiment illustrated in FIG. 3B includes outer flange features 314 which are not included in the embodiment illustrated in FIG. 3A. FIGS. 3C-3D illustrate an alternative embodiment of a ground plane structure with an elevated inner portion 320 disposed adjacent to depressed outer portions 322. Furthermore, the embodiment illustrated in FIG. 3D includes outer flange features 324 which are not included in the embodiment illustrated in FIG. 3C. FIG. 3E illustrates yet another alternative embodiment of the ground plane for use with the low PIM antenna apparatus that consists of a single depressed portion 330 with outer flanges 334 while FIG. 3F illustrates an embodiment of the ground plane which includes a single elevated inner portion 332 with outer flanges 334. In addition, the various ground plane embodiments disclosed herein can be assembled to the radome via snaps (106, FIG. 1B) at various locations on the radome. Alternatively, the various ground plane embodiments disclosed herein could also readily be screwed to the radome with plastic or stainless steel screws via, for example, molded screw bosses located on the radome without affecting PIM performance.

It will be recognized that while certain aspects of the present disclosure are described in terms of specific design examples, these descriptions are only illustrative of the broader methods of the disclosure, and may be modified as required by the particular design. Certain steps may be rendered unnecessary or optional under certain circumstances. Additionally, certain steps or functionality may be added to the disclosed embodiments, or the order of performance of two or more steps permuted. All such variations are considered to be encompassed within the present disclosure described and claimed herein.

While the above detailed description has shown, described, and pointed out novel features of the present disclosure as applied to various embodiments, it will be understood that various omissions, substitutions, and changes in the form and details of the device or process illustrated may be made by those skilled in the art without departing from the principles of the present disclosure. The foregoing description is of the best mode presently contemplated of carrying out the present disclosure. This description is in no way meant to be limiting, but rather should be taken as illustrative of the general principles of the present disclosure. The scope of the present disclosure should be determined with reference to the claims.

What is claimed is:

1. A low passive intermodulation (PIM) antenna apparatus, comprising:

a radiating element comprising a monopole antenna, the monopole antenna comprised of a plurality of protruding portions, wherein each of the protruding portions are separated from one another by an equal amount, each of the protruding portions configured to extend away from a formed ground plane, and one of the plurality of protruding portions comprising a shunt feed coupled to the formed ground plane;

the formed ground plane comprising an axially symmetric shape, the formed ground plane having an electrical path length and a diameter, the electrical path length of the formed ground plane being configured to run in a direction along a diameter of the axially symmetric shape, the electrical path length of the formed ground plane having a length along a surface of the formed ground plane that is greater than the diameter of the formed ground plane; and a connector coupled to the formed ground plane and the radiating element;

wherein the formed ground plane comprises one or more elevated portions and one or more depressed portions, a combination of the one or more elevated portions and the one or more depressed portions being configured to provide the electrical path length of the formed ground plane that is greater than the diameter of the formed ground plane.

2. The low PIM antenna apparatus of claim 1, wherein the radiating element comprises an ultra-wide band quarter-wave monopole radiating element.

3. The low PIM antenna apparatus of claim 2, wherein the plurality of protruding portions consists of three (3) protruding portions separated from one another by approximately one hundred twenty degrees (120°).

4. The low PIM antenna apparatus of claim 3, wherein the one of the plurality of protruding portions comprising the shunt feed is coupled the formed ground plane on two opposing sides of the formed ground plane.

5. The low PIM antenna apparatus of claim 1, further comprising:

a polymer radome; and a mounting base;

wherein the polymer radome and the mounting base are comprised of a substantially similar polymer material.

6. The low PIM antenna apparatus of claim 5, further comprising a cover ring, the cover ring being configured to secure the polymer radome to the mounting base.

7. The low PIM antenna apparatus of claim 5, wherein the polymer radome and the mounting base are configured to be assembled to one another without the use of one or more external fasteners.

8. The low PIM antenna apparatus of claim 7, wherein the polymer radome and the mounting base further comprises one or more tabs that are configured to engage one or more grooves, respectively, the one or more tabs and one or more grooves being configured to fasten the polymer radome to the mounting base.

9. The low PIM antenna apparatus of claim 7, wherein the polymer radome further comprises a first supporting feature, the first supporting feature being configured to support the radiating element.

10. The low PIM antenna apparatus of claim 9, wherein the mounting base further comprises a second supporting feature, the second supporting feature being configured to support the formed ground plane.

11. The low PIM antenna apparatus of claim 10, wherein the connector is coupled to the formed ground plane and the radiating element via a laser welding technique.

12. The low PIM antenna apparatus of claim 5, wherein the formed ground plane is coupled to the polymer radome via one or more polymer radome retention features.

13. The low PIM antenna apparatus of claim 1, wherein the formed ground plane comprises a non-ferromagnetic material.

14. The low PIM antenna apparatus of claim 13, wherein the radiating element, the formed ground plane and the connector are each manufactured from the same non-ferromagnetic material.

15. The low PIM antenna apparatus of claim 1, wherein the low PIM antenna apparatus is further configured to be mounted to an external installation surface.

16. The low PIM antenna apparatus of claim 15, wherein the external installation surface comprises a ceiling tile.

17. The low PIM antenna apparatus of claim 16, wherein the radiating element is configured to operate in a wide frequency band, the wide frequency band comprising a frequency band from about 698 MHz to over approximately 2700 MHz.

18. The low PIM antenna apparatus of claim 17, wherein the connector is selected from the group consisting of: (1) a single custom direct mount connector; (2) an N type connector; and (3) a 7-16DIN type connector.

19. The low PIM antenna apparatus of claim 18, further comprising a semi-flexible cable, the semi-flexible cable being electrically coupled to the connector.

20. A low passive intermodulation (PIM) antenna apparatus, comprising:

a radiating element comprised of a non-ferromagnetic material, the radiating element comprising a monopole antenna, the radiating element comprised of three protruding portions with one of the three protruding portions having a tuning leg associated therewith, wherein each of the protruding portions are separated from one another by an equal amount, each of the three protruding portions configured to extend away from a formed ground plane;

the formed ground plane comprising an axially symmetric shape having an electrical path length along a surface of the formed ground plane, the electrical path length configured to run in a direction along a diameter of the axially symmetric shape, the electrical path length of the formed ground plane having a length along a surface of the formed ground plane that is greater than the diameter of the formed ground plane; and a connector coupled to the formed ground plane and the radiating element;

wherein the tuning leg is secured to the formed ground plane on two opposing surfaces thereof; and wherein the formed ground plane comprises one or more elevated portions and one or more depressed portions, a combination of the one or more elevated portions and the one or more depressed portions being configured to provide the electrical path length of the formed ground plane that is greater than the diameter of the formed ground plane.

* * * * *